US006311943B1

(12) United States Patent
Tang

(10) Patent No.: US 6,311,943 B1
(45) Date of Patent: Nov. 6, 2001

(54) SUSPENSION STRUCTURE FOR CEILING FAN

(76) Inventor: David Tang, No. 3, Nong 5, Lane 66, Yang-Ming St., Feng Yuan City, Taichung Hsien (TW)

( * ) Notice: Subject to any disclaimer, the term of this patent is extended or adjusted under 35 U.S.C. 154(b) by 0 days.

(21) Appl. No.: 09/596,692

(22) Filed: Jun. 19, 2000

(51) Int. Cl.[7] ..... B42F 13/00

(52) U.S. Cl. ..... 248/343; 248/317; 416/5; 416/244 R; 416/246

(58) Field of Search ..... 248/342, 343, 248/344, 317, 318; 416/244 R, 246, 170 R, 5; 403/372, 350

(56) References Cited

U.S. PATENT DOCUMENTS 4,634,345 * 1/1987 Stanek et al. ..... 416/244 R
4,691,889 * 9/1987 Richards ..... 248/343
4,714,230 * 12/1987 Huang ..... 248/343 X
5,613,832 * 3/1997 Su ..... 416/244 R
5,984,640 * 11/1999 Wang ..... 416/244 R
6,042,072 * 3/2000 Chi-Nan ..... 248/343
6,116,559 * 9/2000 Lackey ..... 248/343
6,139,279 * 10/2000 Pearce et al. ..... 416/244 R
6,183,204 * 2/2001 Chang ..... 416/246
6,200,095 * 3/2001 Bucher et al. ..... 416/5
6,203,279 * 3/2001 Moody et al. ..... 416/244 R

* cited by examiner

*Primary Examiner*—Ramon O Ramirez
*Assistant Examiner*—Tan Le
(74) *Attorney, Agent, or Firm*—Charles E. Baxley

(57) ABSTRACT

A suspension structure for a ceiling fan includes a suspension rod, a support disk secured to the suspension rod, a locking block slidably mounted on the suspension rod, and a slide cover rotatably mounted on the suspension rod. The support disk is provided with a tubular base secured on a lower end of the suspension rod. An outer thread is formed on a lower end of the tubular base. A plurality of locking openings are laterally defined in the tubular base. The locking block is provided with a plurality of locking inserts each secured in a respective locking opening of the tubular base of the support disk. The slide cover defines a receiving chamber for receiving the locking block and the tubular base therein. An inner thread is formed on a lower end of the receiving chamber of the slide cover and is engaged with the outer thread of the tubular base of the support disk.

5 Claims, 5 Drawing Sheets

SUSPENSION STRUCTURE FOR CEILING FAN

BACKGROUND OF THE INVENTION

1. Field of the Invention

The present invention relates to a suspension structure, and more particularly to a suspension structure for a ceiling fan.

2. Description of the Related Art

A conventional suspension structure for a ceiling fan in accordance with the prior art shown in FIG. 1 comprises a suspension rod 11 having a lower end defining a first through hole 12, a suspension member 10 secured on the upper end of the suspension rod 11 for securing the suspension rod 11 to the ceiling (not shown), a fitting disk 13 including a tube 14 secured to the suspension rod 11 and defining a second through hole 16 aligning with the first through hole 12 and defining three positioning holes 17, a locking axle 15 extending through the second through hole 16 and the first through hole 12 for securing the fitting disk 13 to the suspension rod 11, and three screws 18 each extending through a respective positioning hole 17 to press the outer wall of the suspension rod 11.

However, a clearance is formed between the suspension rod 11 and the tube 14 so that when the three screws 18 extend through the positioning holes 17 of the tube 14 to press the outer wall of the suspension rod 11, the suspension rod 11 is not easily located at the center of the three screws 18 so that the suspension rod 11 and the tube 14 are not concentrically arranged. Therefore, it is time consuming to calibrate the three screws 18 for centering the suspension rod 11 in the tube 14.

In addition, the three screws 18 are easily loosened during long term rotation of the ceiling fan so that the suspension rod 11 and the tube 14 easily vibrate or sway, thereby greatly effecting the operation of the ceiling fan.

SUMMARY OF THE INVENTION

The present invention has arisen to mitigate and/or obviate the disadvantage of the conventional suspension structure for a ceiling fan.

In accordance with one aspect of the present invention, there is provided a suspension structure for a ceiling fan comprising: a suspension rod; a support disk secured to the suspension rod and provided with a tubular base secured on a lower end of the suspension rod, an outer thread formed on a lower end of the tubular base, a plurality of locking openings laterally defined in the tubular base; a locking block slidably mounted on the suspension rod and provided with a plurality of locking inserts each detachably secured in a respective one of the locking openings of the tubular base of the support disk; and a slide cover rotatably mounted on the suspension rod and defining a receiving chamber for receiving the locking block and the tubular base therein, an inner thread formed on a lower end of the receiving chamber of the slide cover and detachably engaged with the outer thread of the tubular base of the support disk.

By such an arrangement, the slide cover is gradually moved to lock the tubular base of the support disk so that the locking inserts of the locking block are fitted into the locking openings of the tubular base of the support disk in a concentrically forced fit manner, thereby producing an automatic calibration effect for automatically registering the center of the locking inserts of the locking block and the locking openings of the tubular base of the support disk.

In addition, the slide cover can be easily and rapidly secured on the tubular base of the support disk without having to use additional tools, thereby facilitating the user assembling and dismantling the suspension structure of the present invention.

In accordance with an embodiment of the present invention, each of the locking inserts of the locking block and each of the respective locking openings of the tubular base of the support disk include an inclined contact surface for enhancing the tightness of engagement between the locking insert and the locking opening.

Further benefits and advantages of the present invention will become apparent after a careful reading of the detailed description with appropriate reference to the accompanying drawings.

DETAILED DESCRIPTION OF THE INVENTION

Figure 1:
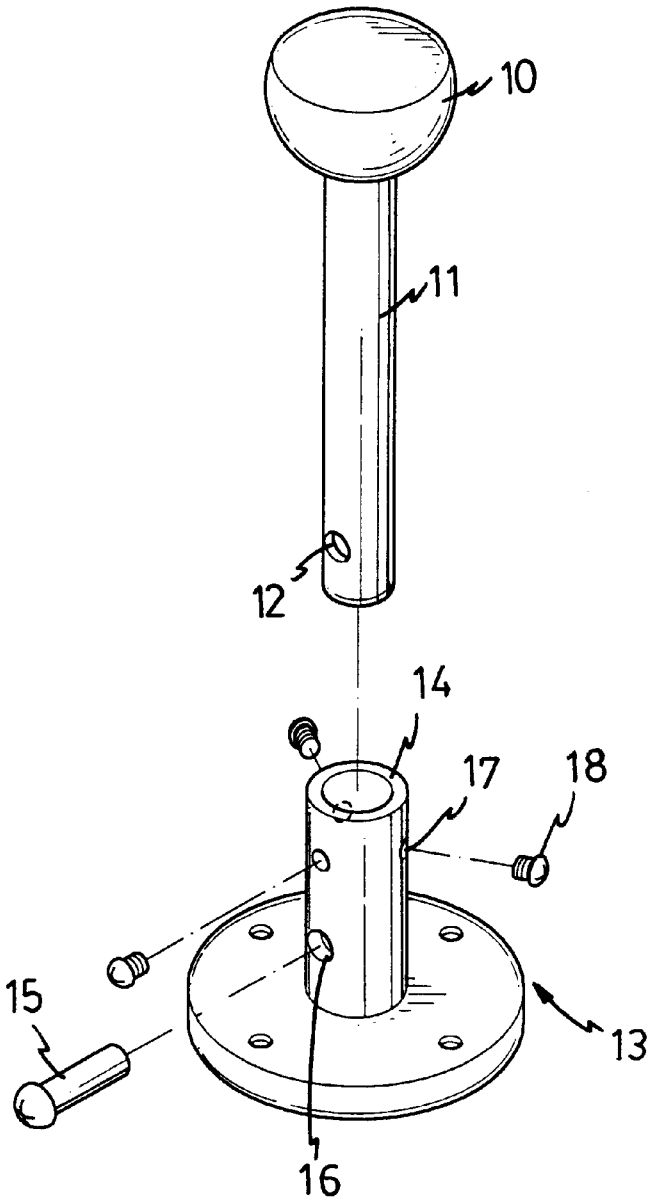
FIG.1 PRIOR ART
FIG. 1 is an exploded view of a conventional suspension structure for a ceiling fan in accordance with the prior art.
Figure 2:
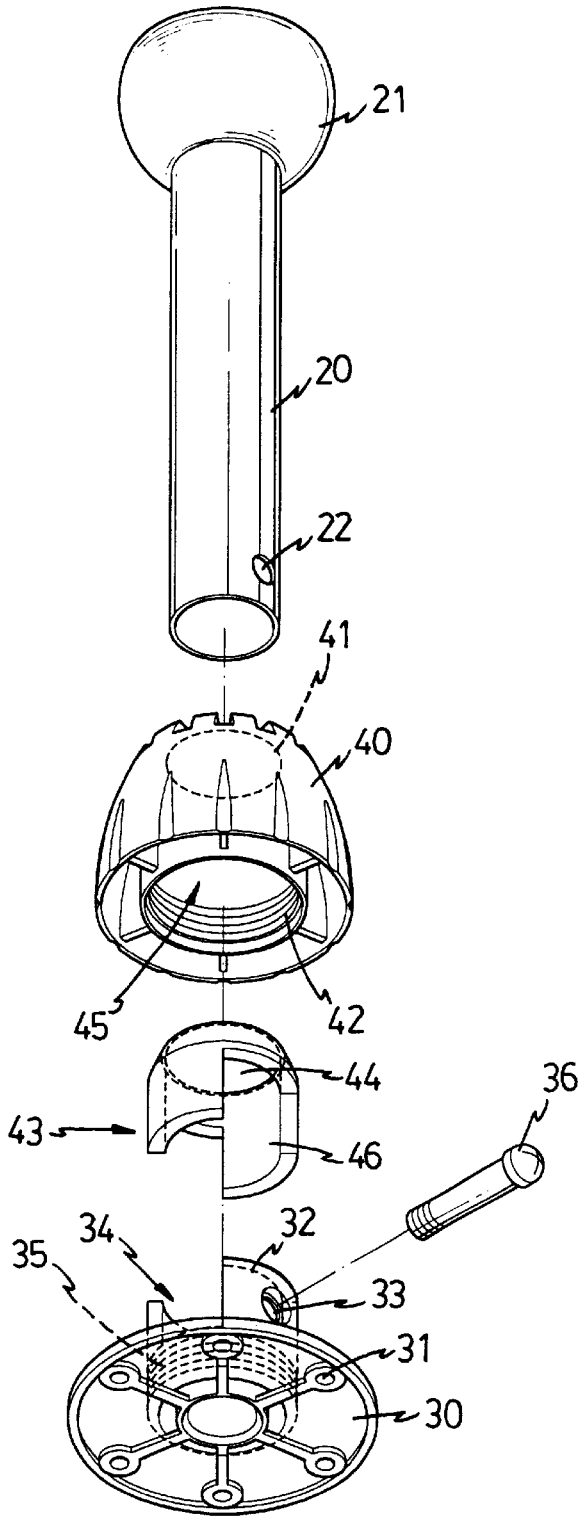
FIG. 2 is an exploded view of a suspension structure for a ceiling fan in accordance with the present invention.
Figure 3:
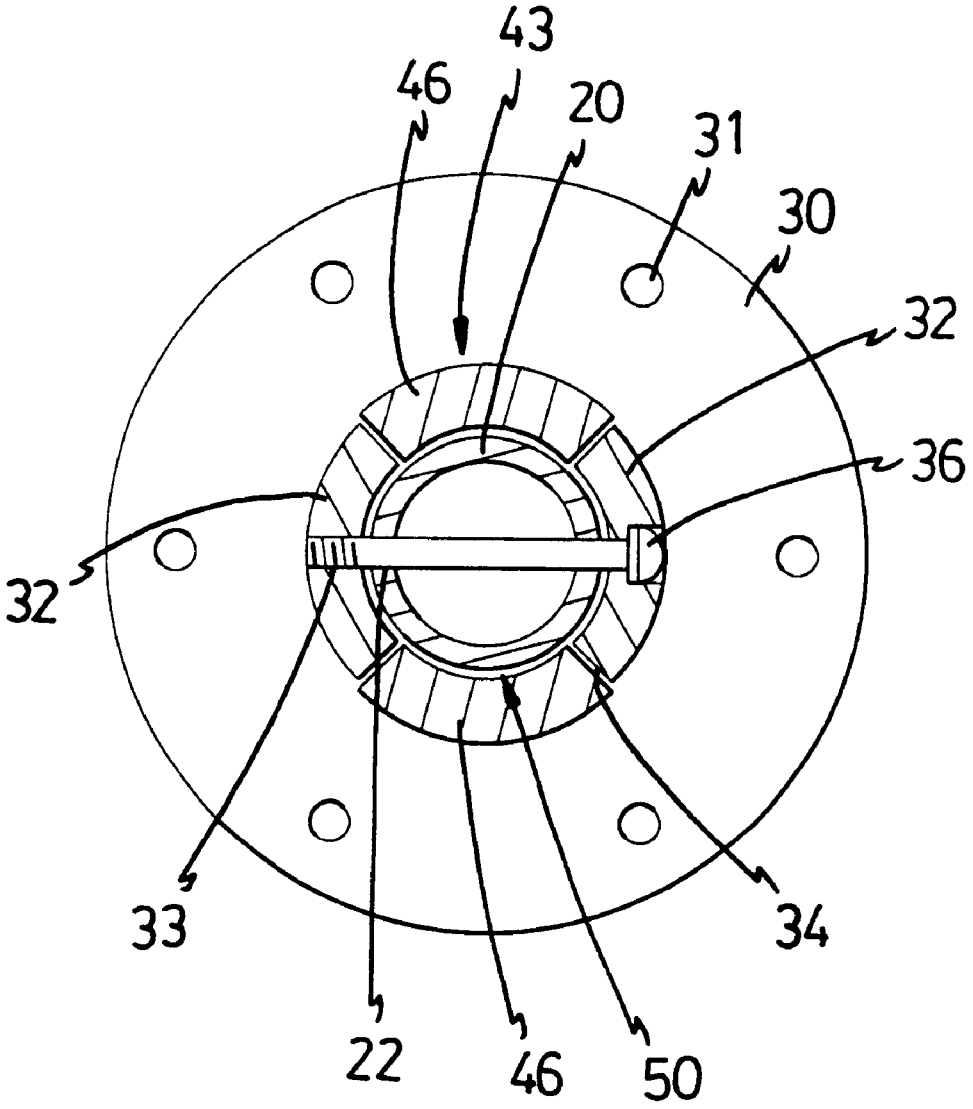
FIG. 3 is a top plan cross-sectional assembly view of the suspension structure as shown in FIG. 2.

Referring to the drawings and initially to FIGS. 2 and 3, a suspension structure for a ceiling fan in accordance with the present invention comprises a suspension rod 20, a support disk 30 secured to the suspension rod 20 and defining a plurality of fitting sockets 31 for securing a motor housing (not shown), a locking block 43 slidably mounted on the suspension rod 20, and a cup-shaped slide cover 40 slidably and rotatably mounted on the suspension rod 20.

The suspension rod 20 has an upper end secured to a cup-shaped suspension member 21 which is used for securing the suspension rod 20 to the ceiling (not shown).

The support disk 30 is provided with a tubular base 32 secured on the lower end of the suspension rod 20. An outer thread 35 is formed on the lower end of the tubular base 32, and a plurality of locking openings 34 are laterally defined in the tubular base 32.

The lower end of the suspension rod 20 defines a first through hole 22. The tubular base 32 of the support disk 30 defines a second through hole 33 aligning with the first through hole 22. The suspension structure further comprises a locking axle 36 extending through the second through hole 33 and the first through hole 22 for securing the tubular base 32 to the suspension rod 20.

The locking block 43 is provided with a plurality of locking inserts 46 each detachably secured in a respective one of the locking openings 34 of the tubular base 32 of the support disk 30. The locking block 43 also defines a hole 44 for allowing passage of the suspension rod 20.

The slide cover 40 defines a receiving chamber 45 for receiving the locking block 43 and the tubular base 32 therein. Preferably, the receiving chamber 45 has a tapered inner wall. An inner thread 42 is formed on the lower end of the receiving chamber 45 of the slide cover 40 and is detachably engaged with the outer thread 35 of the tubular base 32 of the support disk 30. The receiving chamber 45 of the slide cover 40 has an upper end defining a hole 41 for allowing passage of the suspension rod 20.

Figure 4:
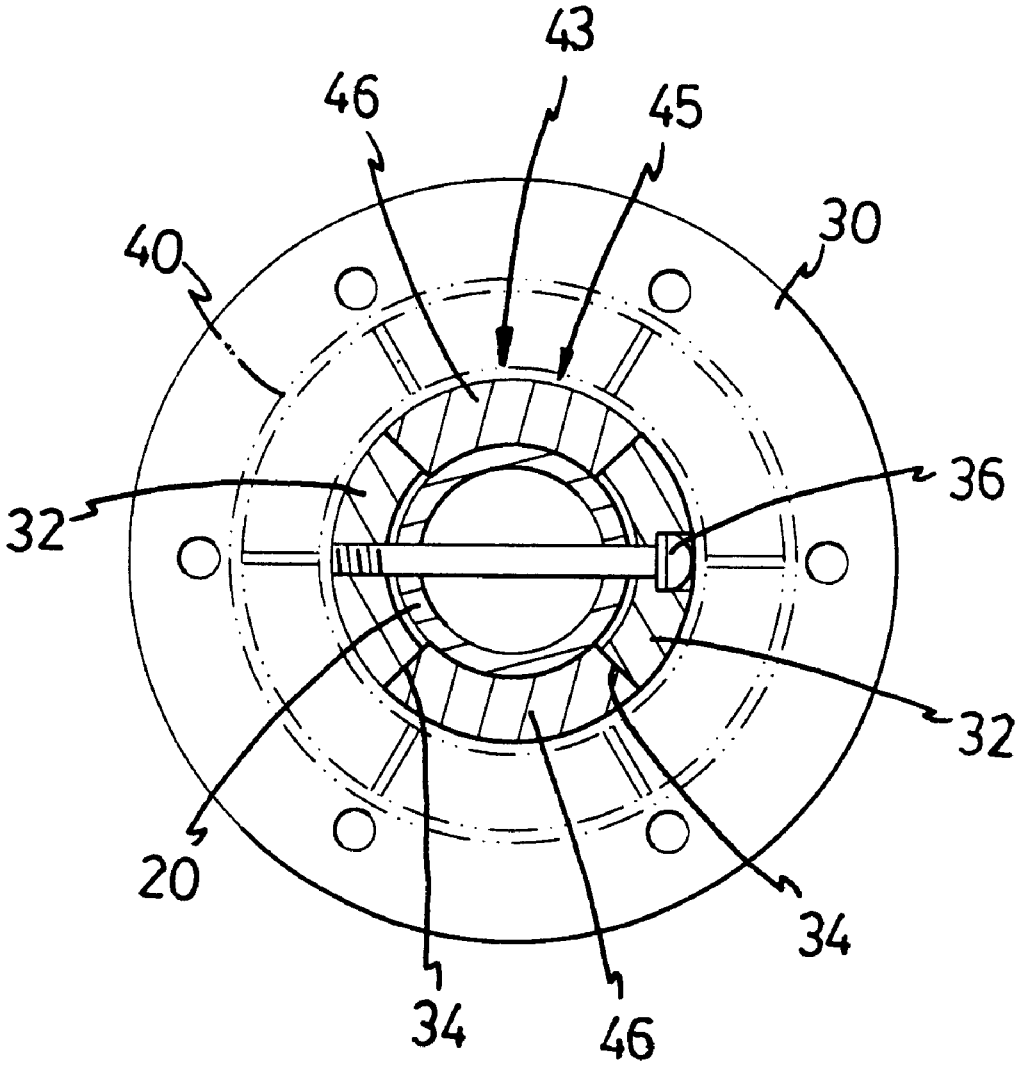
FIG. 4 is an operational view of the suspension structure as shown in FIG. 3.

In operation, referring to FIGS. 3 and 4 with reference to FIG. 2, the slide cover 40 is initially spaced from the locking block 43 and the tubular base 32 of the support disk 30 while each of the locking inserts 46 of the locking block 43 is initially loosely received in the respective locking opening 34 of the tubular base 32 of the support disk 30 so that a clearance 50 is formed between the suspension rod 20, the tubular base 32 of the support disk 30, and the locking insert 46 of the locking block 43 as shown in FIG. 3.

The slide cover 40 is then moved downward to be rotated relative to the tubular base 32 of the support disk 30 so that the inner thread 42 of the slide cover 40 is screwed on the outer thread of the tubular base 32, thereby securing the slide cover 40 on the tubular base 32 of the support disk 30.

During rotation of the slide cover 40, the tapered inner wall of the receiving chamber 45 of the slide cover 40 will abut and press the locking inserts 46 of the locking block 43 and the tubular base 32 of the support disk 30 radially and inward, thereby eliminating the clearance 50 formed between the suspension rod 20, the tubular base 32 of the support disk 30, and the locking insert 46 of the locking block 43 so that each of the locking inserts 46 of the locking block 43 is tightly fitted in the respective locking opening 34 of the tubular base 32 of the support disk 30 as shown in FIG. 4, thereby securely positioning the locking block 43 in the tubular base 32 of the support disk 30 by the slide cover 40.

In addition, the slide cover 40 is gradually moved downward to lock the tubular base 32 of the support disk 30 so that the locking inserts 46 of the locking block 43 are fitted into the locking openings 34 of the tubular base 32 of the support disk 30 in a concentrically forced fit manner, thereby producing an automatic calibration effect for automatically registering the center of the locking inserts 46 of the locking block 43 and the locking openings 34 of the tubular base 32 of the support disk 30.

Further, the slide cover 40 can be easily and rapidly secured on the tubular base 32 of the support disk 30 without having to use additional tools, thereby greatly facilitating the user assembling and dismantling the suspension structure of the present invention.

Figure 5:
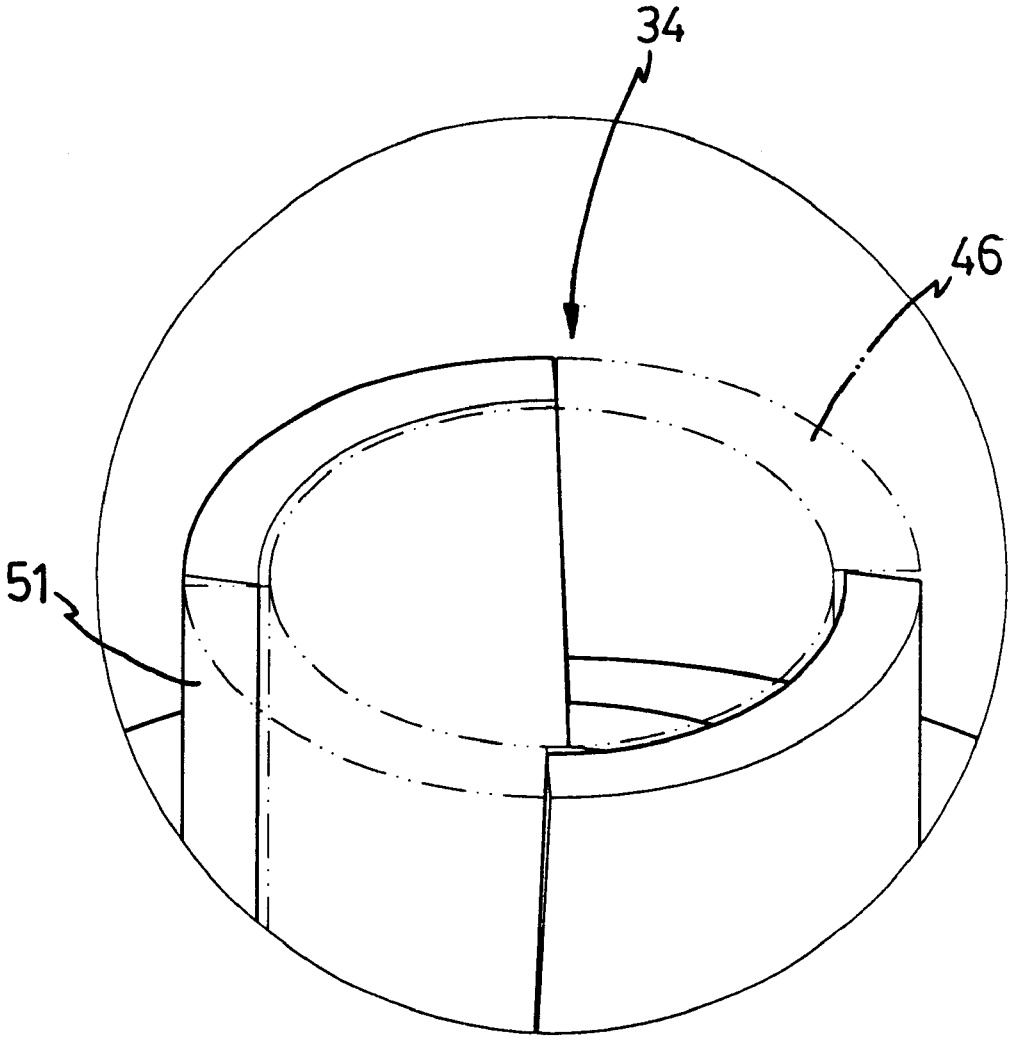
FIG. 5 is a partially perspective assembly view of the suspension structure in accordance with an embodiment of the present invention.

Referring to FIG. 5, in accordance with an embodiment of the present invention, each of the locking inserts 46 of the locking block 43 and each of the respective locking openings 34 of the tubular base 32 of the support disk 30 include an inclined contact surface 51 for enhancing tightness of engagement between the locking insert 46 and the locking opening 34.

It should be clear to those skilled in the art that further embodiments may be made without departing from the scope of the present invention.

What is claimed is:

1. A suspension structure for a ceiling fan comprising:

a suspension rod (20);

a support disk (30) secured to said suspension rod (20) and provided with a tubular base (32) secured on a lower end of said suspension rod (20), an outer thread (35) formed on a lower end of said tubular base (32), a plurality of locking openings (34) laterally defined in said tubular base (32);

a locking block (43) slidably mounted on said suspension rod (20) and provided with a plurality of locking inserts (46) each detachably secured in a respective one of said locking openings (34) of said tubular base (32) of said support disk (30); and a slide cover (40) rotatably mounted on said suspension rod (20) and defining a receiving chamber (45) for receiving said locking block (43) and said tubular base (32) therein, an inner thread (42) formed on a lower end of said receiving chamber (45) of said slide cover (40) and detachably engaged with said outer thread (35) of said tubular base (32) of said support disk (30).

2. The suspension structure in accordance with claim 1, wherein said lower end of said suspension rod (20) defines a first through hole (22), said tubular base (32) of said support disk (30) defines a second through hole (33) aligning with said first through hole (22), and said suspension structure further comprises a locking axle (36) extending through said second through hole (33) and said first through hole (22) for securing said tubular base (32) to said suspension rod (20).

3. The suspension structure in accordance with claim 1, wherein said locking block (43) defines a hole (44) for allowing passage of said suspension rod (20).

4. The suspension structure in accordance with claim 1, wherein said receiving chamber (45) of said slide cover (40) has an upper end defining a hole (41) for allowing passage of said suspension rod (20).

5. The suspension structure in accordance with claim 1, wherein each of said locking inserts (46) of said locking block (43) and each of said respective locking openings (34) of said tubular base (32) of said support disk (30) include an inclined contact surface (51).

* * * * *